US008584569B1

(12) United States Patent
Whitney et al.

(10) Patent No.: US 8,584,569 B1
(45) Date of Patent: Nov. 19, 2013

(54) PLUME EXHAUST MANAGEMENT FOR VLS

(75) Inventors: Michael Ryan Whitney, King George, VA (US); Paul G. Atkinson, III, King George, VA (US); Perry J. Fridley, Jr., King George, VA (US); Keith M. DeLoach, Fredericksburg, VA (US); Luis C. Gominho, Fredericksburg, VA (US); Michael J. Morrison, King George, VA (US); Doyle B. Green, Fredericksburg, VA (US); Douglas L. Wynings, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 58 days.

(21) Appl. No.: 13/374,637

(22) Filed: Dec. 6, 2011

(51) Int. Cl.
*F41F 3/04* (2006.01)

(52) U.S. Cl.
USPC ..... 89/1.8; 89/1.816

(58) Field of Classification Search
USPC ..... 89/1.8, 1.81, 1.812, 1.813, 1.815–1.817
See application file for complete search history.

(56) References Cited

U.S. PATENT DOCUMENTS

| | | | | | |
|---|---|---|---|---|---|
| 2,679,467 | A * | 5/1954 | Sherts | 52/208 |
| 3,754,726 | A * | 8/1973 | Rusbach | 244/3.28 |
| 4,044,648 | A * | 8/1977 | Piesik | 89/1.8 |
| 4,134,327 | A * | 1/1979 | Piesik | 89/1.8 |
| 4,173,919 | A * | 11/1979 | Piesik | 89/1.8 |
| 4,186,647 | A * | 2/1980 | Piesik | 89/1.8 |
| 4,324,167 | A * | 4/1982 | Piesik | 89/1.8 |
| 4,373,420 | A * | 2/1983 | Piesik | 89/1.812 |
| 4,455,917 | A * | 6/1984 | Shook | 89/1.817 |
| 4,498,261 | A * | 2/1985 | Wilson et al. | 52/1 |
| 4,683,798 | A * | 8/1987 | Piesik | 89/1.816 |
| 4,686,884 | A * | 8/1987 | Piesik | 89/1.816 |
| 4,796,510 | A * | 1/1989 | Piesik | 89/1.816 |
| 4,934,241 | A * | 6/1990 | Piesik | 89/1.817 |
| 4,949,618 | A * | 8/1990 | Tarlano | 89/1.809 |
| 5,136,922 | A * | 8/1992 | Piesik | 89/1.812 |
| 5,162,605 | A * | 11/1992 | Piesik | 89/1.817 |
| 5,191,162 | A * | 3/1993 | Czimmek | 89/1.802 |
| 5,194,688 | A * | 3/1993 | Piesik | 89/1.816 |
| 6,079,310 | A * | 6/2000 | Yagla et al. | 89/1.816 |
| 6,755,111 | B2 * | 6/2004 | Ciappi | 89/1.817 |
| 7,350,451 | B2 * | 4/2008 | Barisciano, Jr. | 89/36.15 |
| 7,389,717 | B1 * | 6/2008 | Shah et al. | 89/1.817 |
| 8,181,561 | B2 * | 5/2012 | Riggs et al. | 89/1.817 |
| 8,397,613 | B2 * | 3/2013 | Skurdal et al. | 89/1.817 |
| 2003/0000371 | A1 * | 1/2003 | Ciappi | 89/1.817 |
| 2006/0117940 | A1 * | 6/2006 | Shah et al. | 89/1.816 |
| 2009/0126556 | A1 * | 5/2009 | Skurdal et al. | 89/1.817 |
| 2011/0011251 | A1 * | 1/2011 | Truyman | 89/1.8 |
| 2012/0090454 | A1 * | 4/2012 | Treadway et al. | 89/36.02 |
| 2012/0152090 | A1 * | 6/2012 | Skurdal et al. | 89/1.8 |

* cited by examiner

*Primary Examiner* — Bret Hayes
*Assistant Examiner* — Joshua Freeman
(74) *Attorney, Agent, or Firm* — Gerhard W. Thielmar Esq.

(57) ABSTRACT

A system is provided for directing a flow of gas, including a launching mechanism, a plenum, a layer of meltable material, and an open-ended uptake component. The launching mechanism is adapted to expel rocket exhaust gas. The plenum includes an upper portion having at least one fire resistant breachable plug. The upper portion is adjacent to the launching mechanism. The layer of meltable material is disposed on the upper portion. The heat generated by the gas melts the layer of meltable material. The open-ended uptake component operatively connects to the plenum. The plug moves onto a lower portion of the plenum due to force generated by the gas onto the plug, and the gas flows through the plenum and the uptake component to vent said gas in a controlled manner.

17 Claims, 4 Drawing Sheets

PLUME EXHAUST MANAGEMENT FOR VLS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

1. Technical Field

The embodiments herein generally relate to weapons systems, and, more particularly, to equipment used for protection against the exhaust gases of missile launching systems.

2. Description of the Related Art

A vertical launching system (VLS) consists of a number of cells for holding and firing missiles on surface ships and submarines used by many navies around the world. Typically, each cell can hold a number of different types of missiles, enabling the ship flexibility to load an appropriate set for a given mission and to enable replacement of earlier missiles with upgrades without expensive rework. When the command is given, the missile flies straight up long enough to clear the cell and the ship, and then turns on course. The most popular VLS system in the world is the MK 41, being used by eleven navies around the world. The United States Navy will employ the MK 57 VLS on the U.S.S. Zumwalt class destroyers.

Both MK 41 and MK 57 VLS missile launchers primarily are configured as a plenum and uptake type gas management system. A plenum is a pressurized chamber holding fluids, and the uptake refers to the general upwards/vertical venting of pressurized gas from the plenum. These systems manage gases during a normal missile launch and also during retrained firing. However, a typical plenum and uptake approach results in substantial structural wear caused by normal missile launches, which decreases the ability to withstand a restrained firing, thus, limiting the number of missiles that can be launched prior to gas management system refurbishment.

The MK 41 and MK 57 VLS gas management system plenums protect their plenum floors with ablative material. Additional protection is provided underneath the rocket motor by using a bi-layer ablative material stack. The material on top of the stack is exposed to the rocket motor plume during normal missile fly outs, and the material on the bottom of the stack is exposed only during a missile restrained firing. However, the material is generally inadequate to prevent burn-through when exposed to plume jetting and long burn times because the ablative material, which tends to be expensive, typically do not have sufficient mechanical strength to resist the forces produced by the plume impingement.

The Mk 41 VLS gas management system also uses an aft closure, grid, and sill. The aft closure is a square multi-material, multilayer plate that has diagonal scores that allow it to "blow open" during a rocket motor firing. The sill keeps the aft closure from opening too far and the grid prevents the adjacent aft closures from opening in the opposite direction. However, this type of system requires a substantial number of components, the aft closure layup uses many different materials and a very process-intensive assembly, and the sill and grid are relatively difficult to manufacture and assemble. Moreover, this system is not readily adaptable for use on a general plenum box assemblies because it requires more space above the top of the plenum and more intrusion into the inside of the plenum.

SUMMARY

Therefore, it is desirable to develop an improved gas management system that utilizes the plenum and uptake configuration and is readily adaptable in current weapon systems at reduced cost and complexity. In view of the foregoing, an embodiment herein provides a system for directing a flow of gas, including a launching mechanism, a plenum, a layer of meltable material, and an open-ended uptake component. In various exemplary embodiments, the launching mechanism is adapted to expel rocket exhaust gas.

In various exemplary embodiments, the plenum includes an upper portion having at least one fire resistant breachable plug. The upper portion is adjacent to the launching mechanism. The layer of meltable material is disposed on the upper portion. The heat generated by the gas melts the layer of meltable material. The open-ended uptake component operatively connects to the plenum. The plug moves onto a lower portion of the plenum due to force generated by the gas onto the plug, and the gas flows through the plenum and the uptake component to vent said gas in a controlled manner.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 2:
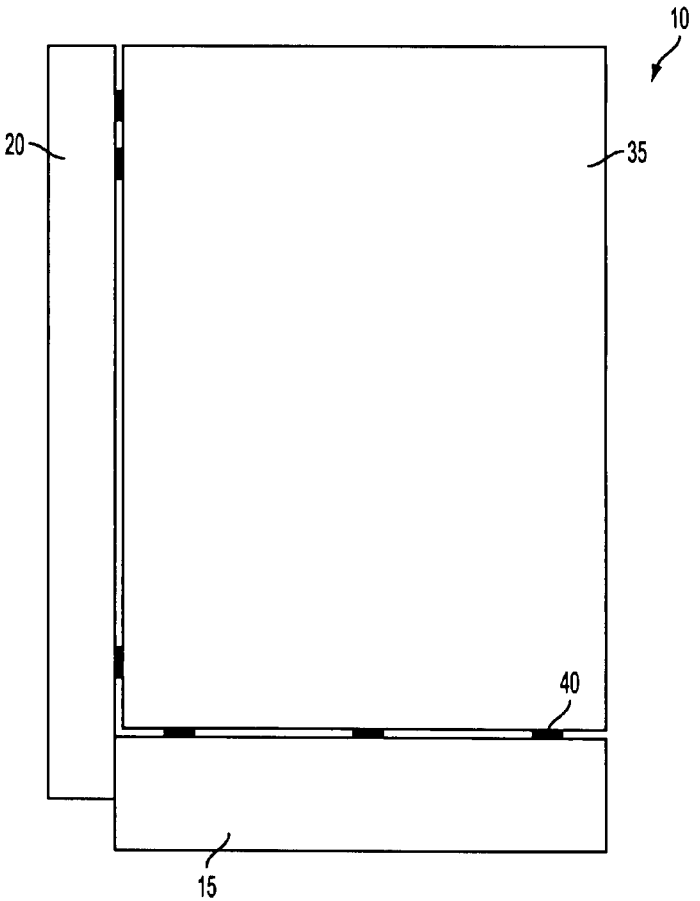
FIG. 2 illustrates a schematic diagram of a missile launcher attached to a gas management system.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a gas management system that utilizes the plenum and uptake configuration to provide protection from the deleterious effects of a rocket plume. Referring now to the drawings, and more particularly to FIGS. 1 through 6, where similar reference characters denote corresponding features consistently throughout the figures, there are shown preferred embodiments.

Figure 1:
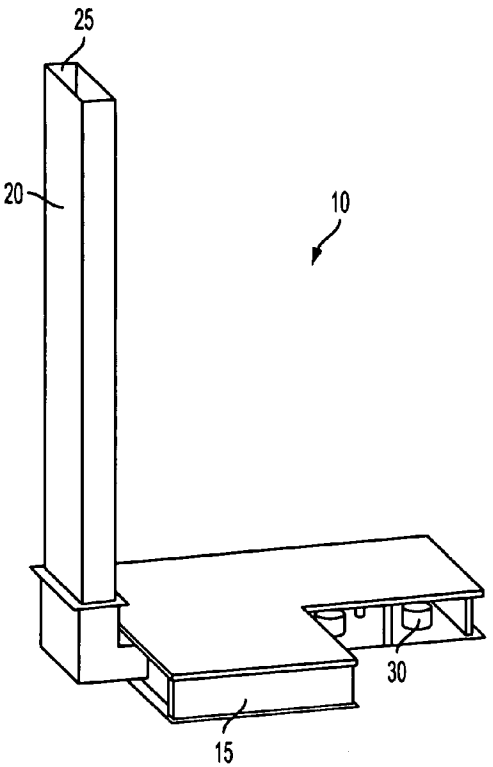
FIG. 1 illustrates a schematic diagram of a gas management system.

FIG. 1 illustrates a schematic diagram of a gas management system 10, which includes a plenum 15 connected to an uptake component 20 having an open end 25 to permit venting of gas that travels through the plenum 15 and then up through the uptake component 20. The gas management system 10 protects surrounding personnel and equipment from the harmful effects of a restrained firing for missile launcher systems that are ordinarily not specifically designed to withstand or protect against the effects of hot missile exhaust gases. Positioned inside the plenum 15 is a gas blast protector mechanism 30, which is described in further detail below with reference to FIG. 3. The view illustrated in FIG. 1 is a cut through view of the plenum 15 in order to illustrate the positioning of the gas blast protector mechanism 30. However, the plenum 15 is generally configured as a box-type configuration with walls extending around all sides to prevent the inadvertent discharge of gas in an uncontrolled manner.

FIG. 2, with reference to FIG. 1, illustrates a schematic diagram of a missile launcher 35 adjacent to a gas management system 10. As shown, the missile launcher 35, which houses or otherwise connects with a rocket/missile (e.g., rocket/missile 43 shown in FIG. 4) is connected to both the plenum 15 and uptake component 20 through a plurality of connecting mechanisms 40, and the embodiments herein are not restricted to any particular type of connecting mechanism or configuration. The missile launcher 35 is in close proximity to the plenum 15, which causes the exhaust gas from the launched rocket/missile to be directed upon the plenum 15 at elevated temperatures.

Figure 4:
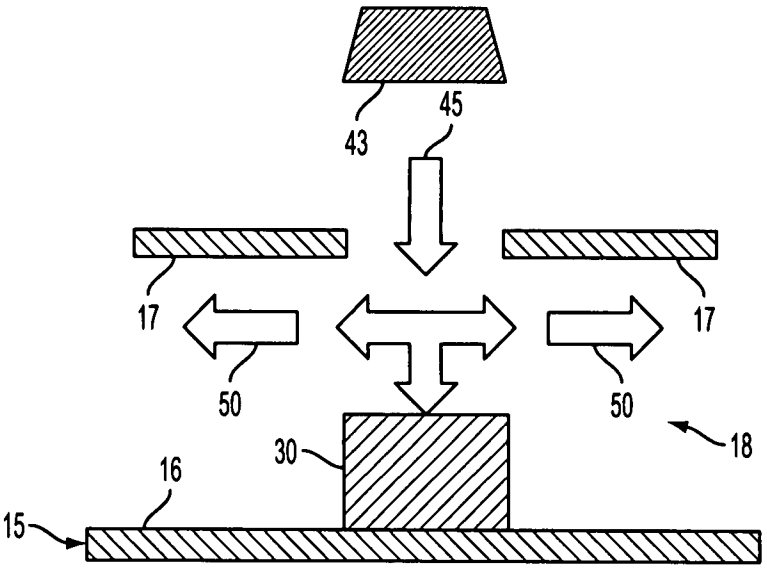
FIG. 4 illustrates a cross-sectional diagram of the gas blast protector of FIG. 3 attached to a plenum of a gas management system.
Figure 3:
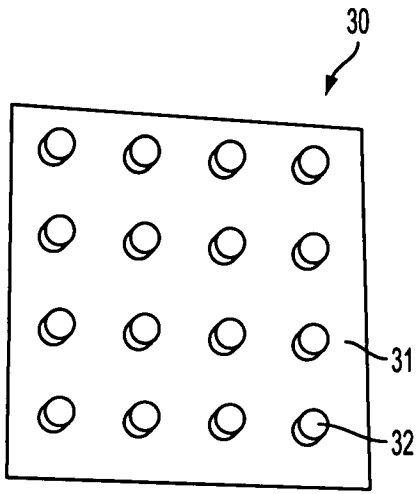
FIG. 3 illustrates a schematic diagram of a gas blast protector.

FIG. 3, with reference to FIGS. 1 and 2, illustrates a schematic diagram of a gas blast protector mechanism 30 comprising a plate 31 and a plurality of raised bumps 32 extending from the plate 31. The plate 31 and bumps 32 may be made from a variety of mechanically strong materials including ceramics. As described below, the gas blast protector mechanism 30 may or may not be utilized with respect to the embodiments herein. As shown in FIG. 4, with reference to FIGS. 1 through 3, the plate 31 is placed on the lower portion (i.e., floor) 16 of the plenum 15.

In FIG. 4, the various block arrows depict the flow of gas as a result of a rocket/missile 43 being launched. The initial exhaust gas 45 purges the upper portion 17 (i.e., ceiling) of the plenum 15 and then extends downward through the inner chamber 18 of the plenum 15. Thereafter, upon contacting the gas blast protector 30, the gas is diverted in a substantially horizontal direction in relation to the plenum 15 such that the diverted gas 50 flows through the chamber 18 and then through the connecting uptake component 20 (not shown in FIG. 4) to be vented in a controlled manner. The gas blast protector 30 assists in reducing the mechanical and thermal impact of the gas 45 on the floor 16 of the plenum 15, thereby aiding in the maintenance of the structural integrity of the floor 16 of the plenum 15. In other words, the gas blast protector 30 protects the floor 16 of the plenum 15 from burning through when exposed to the direct impingement of hot missile exhaust gas 45. As mentioned above, the gas blast protector 30 is an optional component of the embodiments herein.

Figure 5A:
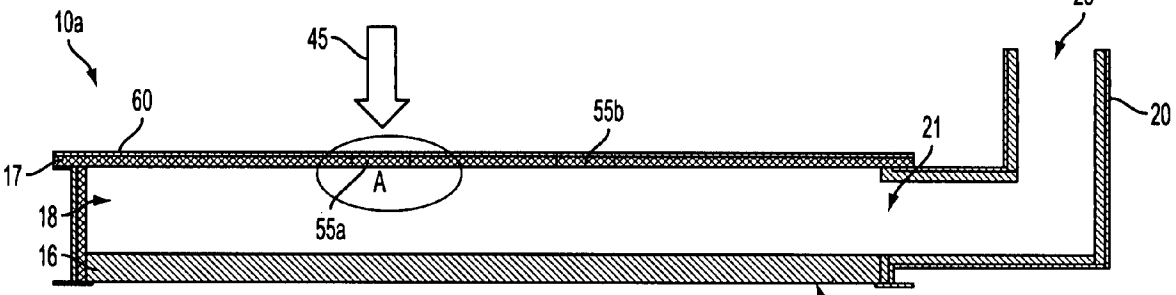
FIG. 5A illustrates a cross-sectional diagram of a breachable plenum plug gas management system in a closed state of operation.
Figure 5B:
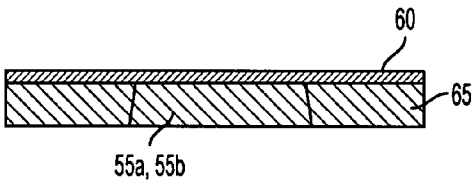
FIG. 5B illustrates a magnified cross-sectional view of the encircled area 'A' of the breachable plenum plug gas management system of FIG. 5A.
Figure 5C:
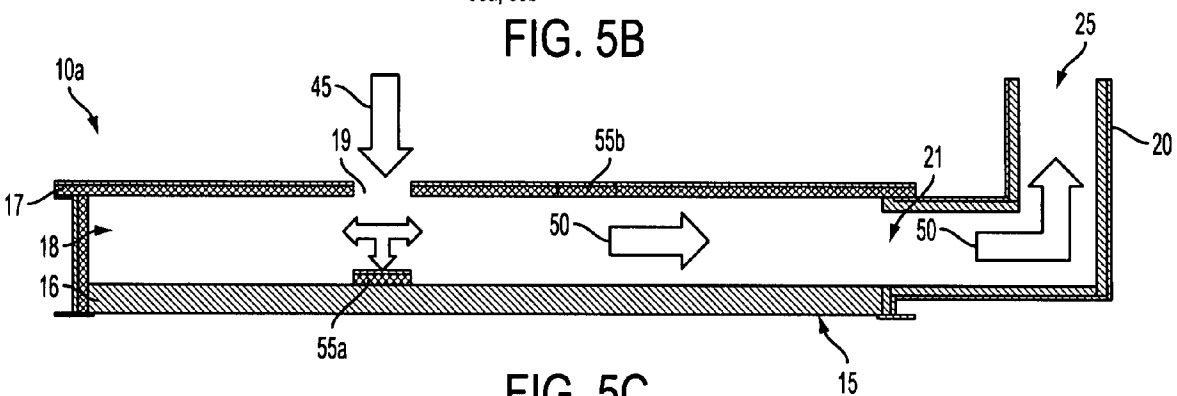
FIG. 5C illustrates a cross-sectional diagram of a breachable plenum plug gas management system in an open state of operation.

FIGS. 5A through 5C, with reference to FIGS. 1 through 4, illustrate various cross-sectional diagrams of a breachable plenum plug gas management system 10*a*. FIG. 5A illustrates the system 10*a* in a closed state of operation while FIG. 5C illustrates the system 10*a* in an open state of operation. FIG. 5B illustrates a magnified cross-sectional view of the encircled area 'A' of the breachable plenum plug gas management system 10*a* of FIG. 5A.

As illustrated, the gas management system 10*a* includes a plenum 15 having an upper portion 17 with a plurality of breachable (i.e., movable) plugs 55*a*, 55*b*; a lower portion 16; and a chamber 18 separating the upper portion 17 from the lower portion 16. The system 10*a* also includes an uptake component 20 operatively connected to the plenum 15. In an optional embodiment, at least one gas blast protection component 30 (not shown in FIGS. 5A through 5C) may be positioned over the lower portion 16 of the plenum 15. The plurality of breachable (i.e., movable) plugs 55*a*, 55*b* move in a direction from the upper portion 17 towards the lower portion 16 upon impact of rocket motor exhaust gas 45 directed thereon.

As shown in FIG. 5B, the plugs 55*a*, 55*b* may incorporate a tapered shape or alternatively may comprise a stepped shape (not shown). While these two shapes/configurations are described with respect to the plugs 55*a*, 55*b*, the embodiments herein are not restricted to a particular geometric configuration of the plugs 55*a*, 55*b*, as any type of configuration that permits breach of the plugs 55*a*, 55*b* is permitted. Additionally, the system 10*a* further includes a layer of meltable material 60 over the upper portion 17 of the plenum 15, and a layer of fire resistant material 65 under the layer of meltable material 60. In one embodiment, the material used for the layer of fire resistant material 65 is the same material used for the plugs 55*a*, 55*b*. Thus, the plugs 55*a*, 55*b* are fire resistant, and the release of the plug 55*a* is dictated by the force of the exhaust gas 45 rather than the heat generated by the gas 45.

The layer of fire resistant material 65 may be configured to be substantially aligned with the plugs 55*a*, 55*b*. Due to the fire resistant qualities of the plugs 55*a*, 55*b*, the floor 16 of the plenum 15 is protected from the deleterious effects of the gas 45 without the need of a gas blast protector 30. Additionally, once the plug 55*a* hits the lower portion 16 of the plenum 15, the plug 55*a* provides the same gas diversion quality as the raised bumps 32 of a gas blast protector 30. However, should additional protection of the floor 16 of the plenum 15 be desired, then the embodiments herein may incorporate a gas blast protector 30 in the plenum 15. The uptake component 20 comprises a first open end 21 connected to the plenum 15 and a second open end 25 to permit controlled venting of the gas 50.

The plugs 55*a*, 55*b* move in substantially one direction only (i.e., generally in the direction from the upper portion 17 to the lower portion 16 of the plenum 15). The discharged plug 55*a* caused by the hot missile exhaust gas 45 creates an opening 19 in the upper portion 17 of the plenum 15 located directly underneath the exhausting rocket motor (e.g., rocket/missile 43 of FIG. 4). However, non-discharged plug 55*b* as well as the layer of fire resistant material 65 prevents exhaust gas 45, 50 from leaking back underneath adjacent non-exhausting rocket motors (not shown). When the plug 55*a* underneath the exhausting rocket motor functions (i.e., is released), the rocket motor exhaust gas 45 flows into the inner chamber 18 of the plenum 15 and is ducted away to a safe location (e.g., through the uptake component 20). However, the non-exhausting rocket motors (not shown) are protected from the hot gases, due to the non-breached adjacent plug 55*b* preventing sympathetic rocket motor ignition.

Accordingly, since the non-exhausting rocket motors do not direct hot gas 50 onto plug 55*b*, then the plug 55*b* remains in place in the upper portion 17 of the plenum 15 without breaching. Therefore, only plug 55*a* is breached because a rocket is launched directly above this location of the upper portion 17 of the plenum 15. The gas 45 directed onto the plenum 15 first strikes the layer of meltable material 60 over the upper portion 17 of the plenum 15.

The heat capacity of the meltable material 60 is less than the temperature of the gas 45 thereby causing the material 60 to melt, which then allows the gas 45 to strike the plug 55*a* at a force sufficient to cause the plug 55*a* to dislodge from the upper portion 17 of the plenum and down towards the lower portion 16 of the plenum 15. The layer of fire resistant material 65 restrains the gas 45 from causing the breach of adjacent plug 55*b* and to maintain the structural integrity of the remaining areas of the upper portion 17 of the plenum 15. The meltable material 60 and the fire resistant material 65 of the plugs 55*a*, 55*b* are not restricted to particular materials and need only be dictated by the thermal environment.

The system 10*a* protects a launcher 35 and surrounding equipment from the effects of a restrained firing even though the launcher 35 was not necessarily designed to mitigate a restrained firing. Due to the use of the fire resistant material 65, the gas management system 10*a* does not wear out due to the number of missile firings occurring.

By utilizing the plugs 55*a*, 55*b* and multi-layered 60, 65 upper portion 17 of the plenum 15, the embodiments herein achieve higher mechanical strength by combining the meltable material 60 and the heat resistant material 65. This is because meltable materials are plentiful and can be selected for higher strength, whereas heat-resistant materials are more specialized and typically weaker mechanically. Furthermore, the plugs 55*a*, 55*b* are relatively easy to machine due to the materials that they constitute, which reduces manufacturing costs.

The embodiments herein also permit the redirection of the exhaust gases 45, 50 such that their detrimental effects on structural components (i.e., plenum 15) are mitigated. The embodiments herein require fewer components and fewer materials than conventional gas management systems because the system 10*a* utilizes a less complex configuration by requiring less room above and inside the plenum 15 (e.g., the embodiments herein do not require an additional gas blast protector 30). This is because, the system 10*a* does not use a grid, and since a sill is also not required, there are no required extraneous flow inhibiting items protruding into the plenum 15.

While various material descriptions are described herein, the gas management system 10*a* may be made from a number of materials for the structural as well as the heat resistant aspects of the design. The materials used for the system 10*a* can be chosen based on mechanical strength under high heating rates and long burn time, ease of machining, ease of availability, and cost.

Figure 6:
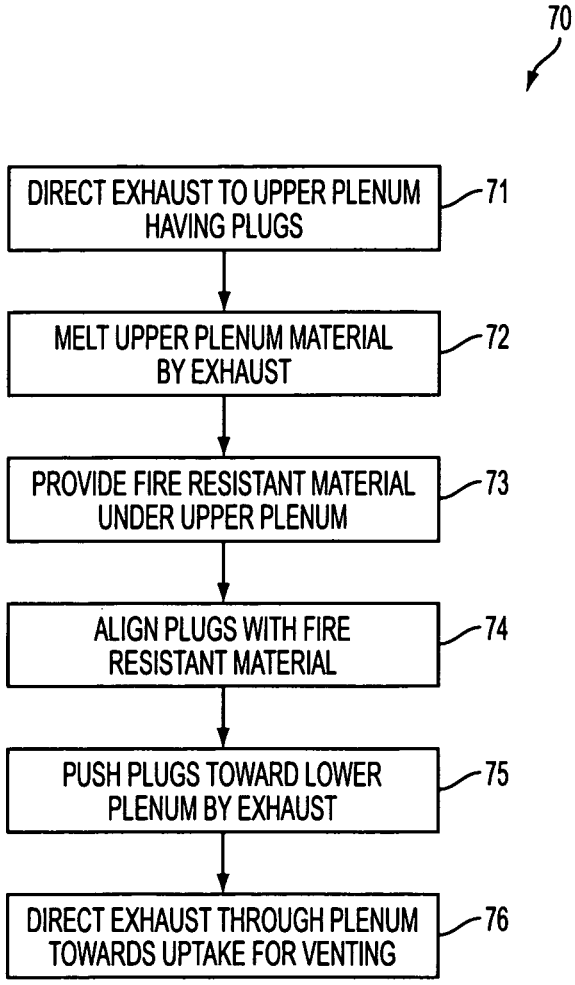
FIG. 6 is a flow diagram illustrating a method according to an embodiment herein.

FIG. 6, with reference to FIGS. 1 through 5C, is an exemplary flow diagram 70 illustrating a method according to an embodiment herein. At step 71, exhaust gas 45 from a missile's rocket motor 43 is directed to an upper portion 17 of the plenum 15 having fire-resistant breachable plugs 55*a*, 55*b*. At step 72, an upper layer of meltable material 60 melts in response to heat generated by the gas 45 in conjunction with step 73 of disposing a fire-resistant material 65 under the meltable material 60. At step 74, the plugs 55*a*, 55*b* are aligned with the fire-resistant material 65. At step 75, the plugs 55*a*, 55*b* are pushed down by the exhaust gas 50 being positioned directly above. At step 76, the gas 50 is directed through the plenum 15 towards an uptake component 20 for venting.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A gas management system for discharging exhaust gas from a missile contained within a launcher, said system comprising:

a plenum that defines a chamber for receiving the exhaust gas, said plenum comprising:

an upper portion defining a ceiling of said chamber comprising a fire resistant substrate with a plurality of fire resistant uni-directionally movable plugs disposed thereon, each plug being directable into said chamber by the exhaust gas thereby leaving a corresponding opening in said upper portion, said upper portion overlaid by a meltable layer to secure said each plug within said corresponding opening, said meltable layer releasing said each plug in response to exposure to the exhaust gas, a lower portion defining a floor of said chamber, wherein said chamber separates said upper portion from said lower portion and receives the exhaust gas through said opening; and an uptake component connected to said plenum via said chamber for venting the exhaust gas.

2. The system of claim 1, wherein the plurality of movable plugs comprise a tapered shape.

3. The system of claim 1, wherein the plurality of movable plugs comprise a stepped shape.

4. The system of claim 1, wherein said uptake component comprises:

a first open end connected to said plenum; and a second open end.

5. The system of claim 1, further comprising at least one gas blast protection component over said lower portion of said plenum, wherein said at least one gas blast protection component comprises a plate and a plurality of raised bumps extending from said plate.

6. An exhaust gas directing system for a missile launcher that contains a booster motor, said system comprising:

a launching mechanism adapted to expel rocket exhaust gas from the motor;

a plenum comprising upper and lower portions that define a chamber, said upper portion having at least one fire resistant breachable plug, wherein said upper portion communicates said gas from said launching mechanism through an opening upon release of said plug into said chamber;

a layer of meltable material disposed on said upper portion to secure said plug within said opening on said upper portion, wherein heat generated by said gas melts said layer of meltable material, thereby releasing said plug; and an open-ended uptake component operatively connected to said plenum via said chamber, wherein said plug moves onto said lower portion of said plenum due to force generated by said gas onto said plug, and wherein said gas flows through said plenum and said uptake component to vent said gas in a controlled manner.

7. The system of claim 6, wherein said plug is configured to permit movement away from said upper portion towards said lower portion.

8. The system of claim 6, wherein said at least one fire resistant breachable plug comprises a plurality of fire resistant breachable plugs, wherein only plugs positioned directly below a direct expulsion of said rocket exhaust gas emanating from said launching mechanism are released from said upper portion of said plenum towards said lower portion of said plenum.

9. The system of claim 6, further comprising a layer of fire resistant material under said upper layer.

10. The system of claim 6, further comprising at least one gas blast protection component over said lower portion of said plenum.

11. The system of claim 6, wherein said rocket exhaust gas is expelled directly over a plug, and wherein said plugs only move in one direction.

12. A method for directing a flow of rocket exhaust gas from a missile launcher, said method comprising:

directing the rocket exhaust gas onto an upper portion of a plenum comprising a plurality of fire resistant breathable plugs disposed thereon within corresponding openings;

melting an upper layer of material from said upper portion, wherein said melting is caused by heat generated by the rocket exhaust gas;

pushing said plugs positioned directly exposed to a direct expulsion of the rocket exhaust gas towards a lower portion of said plenum, wherein said pushing is caused by force generated by the rocket exhaust gas onto said plugs; and directing said gas through said plenum towards an uptake component to vent the rocket exhaust gas in a controlled manner.

13. The method of claim 12, wherein said plugs are configured to only permit movement away from said upper portion towards said lower portion.

14. The method of claim 12, further comprising providing a layer of fire resistant material under said upper layer.

15. The method of claim 14, further comprising aligning said plugs with said layer of fire resistant material.

16. The method of claim 12, further comprising protecting said lower portion of said plenum from said force generated by the rocket exhaust gas.

17. The method of claim 12, wherein said directing of the rocket exhaust gas occurs directly over a plug.

* * * * *

UNITED STATES PATENT AND TRADEMARK OFFICE

CERTIFICATE OF CORRECTION

PATENT NO. : 8,584,569 B1
APPLICATION NO. : 13/374637
DATED : November 19, 2013
INVENTOR(S) : Michael Ryan Whitney et al.

It is certified that error appears in the above-identified patent and that said Letters Patent is hereby corrected as shown below:

On the Title Page:

(75) Inventors: "Paul G. Atkinson, III" should be corrected to --Paul G. Atkinson--, without the suffix (as consistent with the declaration).

(74) Attorney, Agent or Firm: "Gerhard W. Theilmar" should be corrected to --Gerhard W. Thielman--.

Signed and Sealed this
Twenty-fifth Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,584,569 B1
APPLICATION NO. : 13/374637
DATED : November 19, 2013
INVENTOR(S) : Michael Ryan Whitney et al.

It is certified that error appears in the above-identified patent and that said Letters Patent is hereby corrected as shown below:

Title Page:

(75) Inventors: "Perry J. Fridley Jr." should be corrected to -- Perry L. Fridley Jr. --.

Signed and Sealed this
Third Day of June, 2014

Michelle K. Lee

Michelle K. Lee
*Deputy Director of the United States Patent and Trademark Office*